United States Patent [19]

Körner et al.

[11] Patent Number: 5,073,244

[45] Date of Patent: Dec. 17, 1991

[54] SELF-SUPPORTING RECEPTACLE, ESPECIALLY FOR USE AS AN ELECTROLYSIS CELL

[75] Inventors: Hans Körner, Wies; Franz Wurm, Graz, both of Austria

[73] Assignee: Körner Chemieanlagenbau Gesellschaft m.b.H., Wies, Austria

[21] Appl. No.: 488,641

[22] Filed: Mar. 5, 1990

[30] Foreign Application Priority Data

Mar. 21, 1989 [AT] Austria ..... 661/89

[51] Int. Cl.[5] ..... C25B 9/00; C25C 7/00

[52] U.S. Cl. ..... 204/242

[58] Field of Search ..... 204/242, 259, 279

[56] References Cited

U.S. PATENT DOCUMENTS

| | | | |
|---|---|---|---|
| 3,679,568 | 7/1972 | Westerlund | 204/242 |
| 4,310,404 | 1/1982 | Satoh et al. | 204/252 |
| 4,651,893 | 3/1987 | Mooney | 220/445 |

*Primary Examiner*—John Niebling
*Assistant Examiner*—Caroline Koestner
*Attorney, Agent, or Firm*—Herbert Dubno

[57] ABSTRACT

A self-supporting receptacle, especially for use as an electrolysis cell, has its walls composed of glass fiber reinforced synthetic resin in a double-shell construction with the shells held apart by spacers.

10 Claims, 3 Drawing Sheets

SELF-SUPPORTING RECEPTACLE, ESPECIALLY FOR USE AS AN ELECTROLYSIS CELL

FIELD OF THE INVENTION

Our present invention relates to a self-supporting receptacle, especially for use as an electrolysis cell.

BACKGROUND OF THE INVENTION

Customarily, the receptacles used for electrolysis cells have been concrete receptacles which, in order to minimize the attack of the corrosive electrolyte upon the concrete, have been provided with an appropriate rubber lining or a lining of a plastic (synthetic resin) material.

In practice, such linings have been found to be very sensitive to mechanical stresses and attack. Indeed with even a minimum of stress, the lining can be torn or penetrated to allow the acid contained in the receptacle, usually sulfuric acid, to leak into contact with the concrete of the receptacle. The concrete of the receptacle is thereby strongly attacked and can deteriorate rapidly, creating the danger of releasing the contents of the electrolysis cell into the environment or the workplace.

OBJECTS OF THE INVENTION

It is the principal object of the present invention to provide an electrolysis cell receptacle which overcomes these disadvantages.

A more specific object of the invention is to provide an electrolysis cell receptacle which does not depend upon a mechanically sensitive lining for its structural integrity.

Still another object of this invention is to provide an electrolysis cell which will not suffer the type of attack which has been encountered heretofore when concrete has been subjected to deterioration by sulfuric acid or other electrolysis cell acids.

SUMMARY OF THE INVENTION

These objects are attained, in accordance with the invention, by forming the receptacle from glass-fiber-reinforced synthetic resin (plastic), by providing the receptacle so that it has a double-shell construction and by spacing the two shells of the receptacle from one another.

More particularly, the self-supporting receptacle for an electrolysis cell according to the invention comprises wall means for defining lateral walls and a bottom of an enclosure, each of the walls being comprised of two spaced-apart wall members composed of glass-fiber-reinforced synthetic resin and separator means for spacing apart the wall members of the walls.

According to a feature of the invention, between the shells of the receptacle, spacers which can be composed of synthetic resin material can be disposed. Advantageously, the space between the shells can be filled with a synthetic resin/mineral mixture.

It has been found to be particularly advantageous to dispose between the receptacle shells, prestressing elements which serve to apply a prestress to the inner shell to ensure that it has a load-bearing capacity sufficient to accommodate the liquid contents of the cell, i.e. the electrolyte.

The prestressing elements can be glass-fiber strands, carbon-fiber strands or polyester-fiber strands or can contain such strands or can be corrosion-resistant steel wire, e.g. stainless steel wire, formed with a protective sheath of synthetic resin material. The synthetic resin materials used in this description are those which are resistant to attack by the cell acids, for example, epoxy resins.

According to still another feature of the invention, the prestressing elements apply a prestress which increases from the bottom of the receptacle to the upper edges thereof. The receptacle is usually upwardly open. When the prestressing elements are arranged in groups in accordance with a feature of the invention, the number of such elements per group can increase from the bottom of the receptacle to its upper edges.

According to another feature of the invention, the receptacle is provided externally of the enclosure along the upper edges of a frame of structural-steel shapes, e.g. channels, I-beams, H-beams or angles, also referred to as steel profiles, receiving at least one prestressing element acting inwardly upon the enclosure walls.

It has been found to be advantageous, moreover, to provide in the vertical plane between the shells prestressing elements which run in a zigzag pattern and extend from the corners of the receptacle upwardly with inflection bends around the spacers between the wall members.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
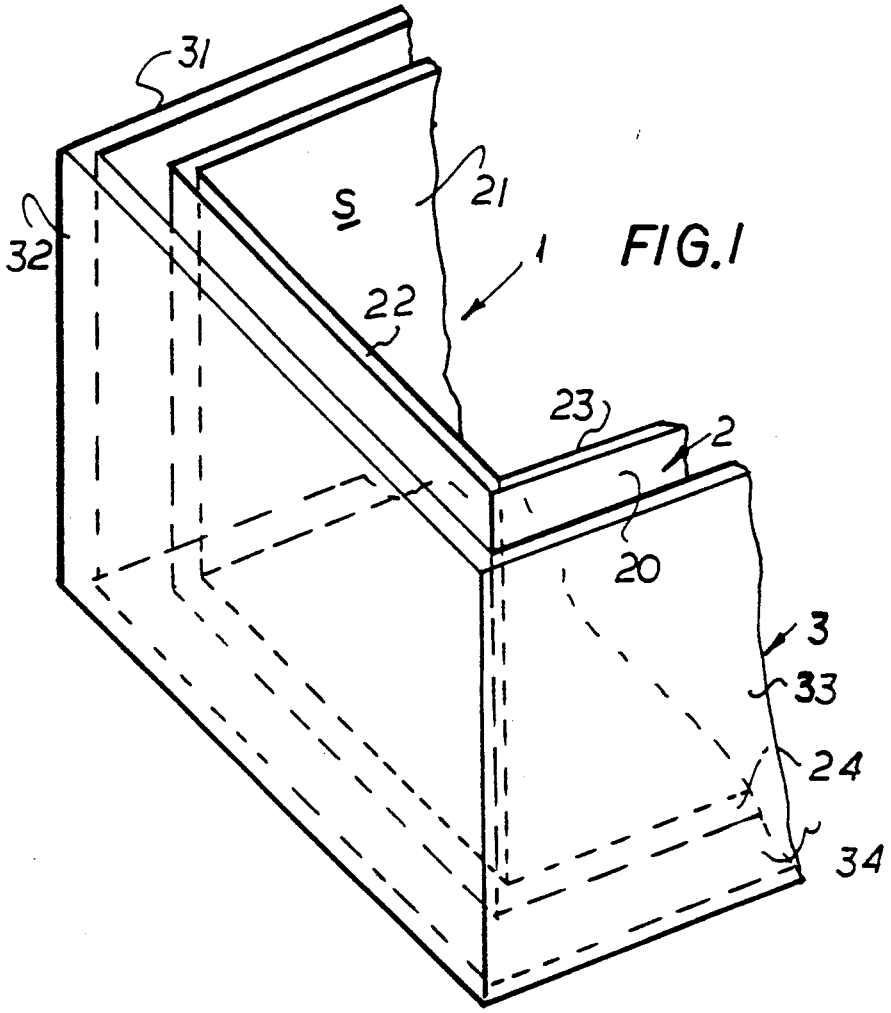
FIG. 1 is a fragmentary perspective view of the shells forming the enclosure of the invention.

A receptacle for an electrolysis cell is represented at 1 in FIG. 1 and can be seen to be composed to two shells 2 and 3 respectively. The shells 2 and 3 are spaced apart by the space 20. The shells 2 and 3 have lateral walls 21, 22, 23 and bottom wall 24 for the inner shell 2 and lateral walls 31, 32, 33 and bottom wall 34 for the outer shell 3. The receptacle is open upwardly so that the space S can receive an electrolyte as is customary with electrolysis cells using sulfuric acid as an electrolyte.

Figure 2A:
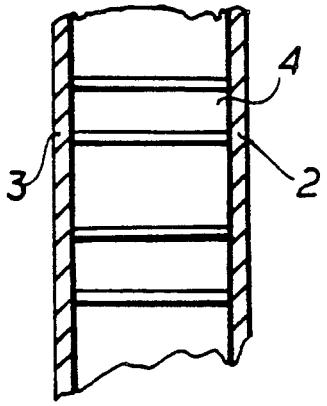
FIGS. 2*a* and 2*b* are cross sections through the wall means of the receptacle.
Figure 2B:
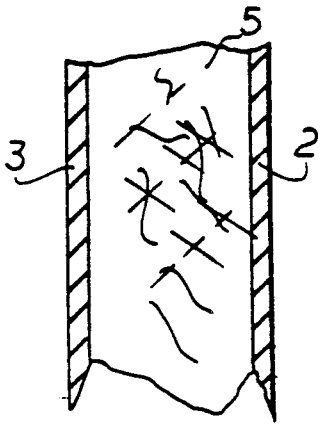
Figure 3:
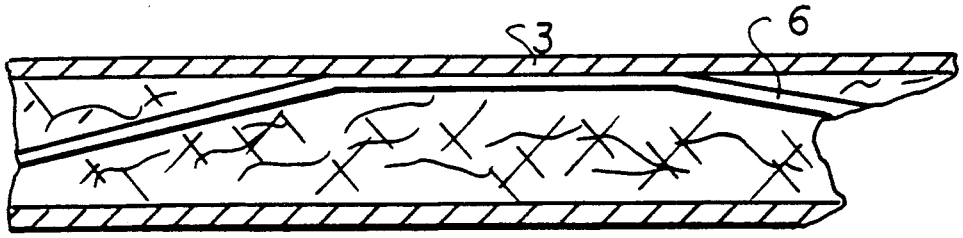
FIG. 3 is a section in plan view showing the receptacles provided with prestressing elements.
Figure 4:
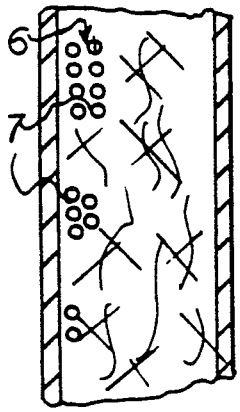
FIG. 4 is a vertical section showing the arrangement of the prestressing elements in groups.
Figure 5:
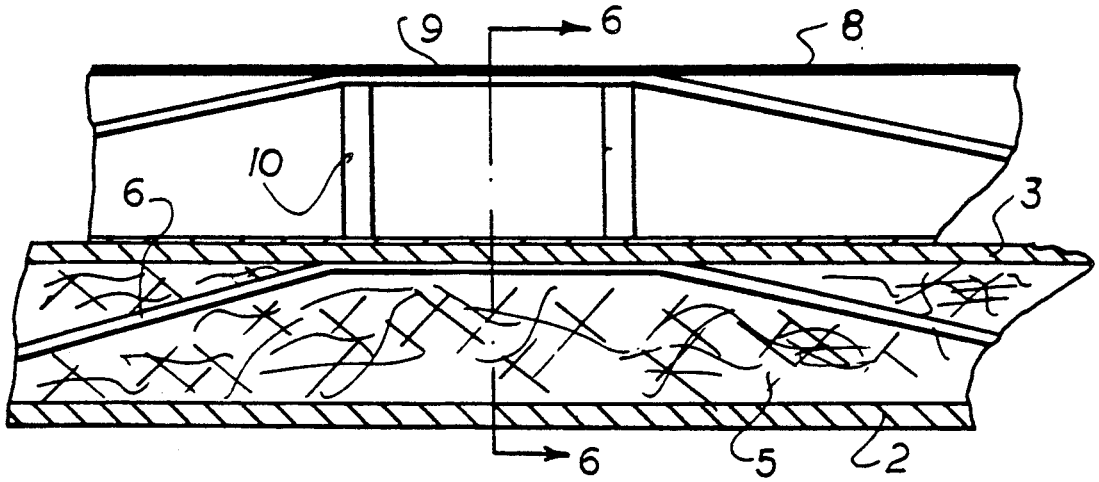
FIG. 5 is a fragmentary sectional view seen in plan view illustrating the use of a frame in the receptacle of the invention.
Figure 6:
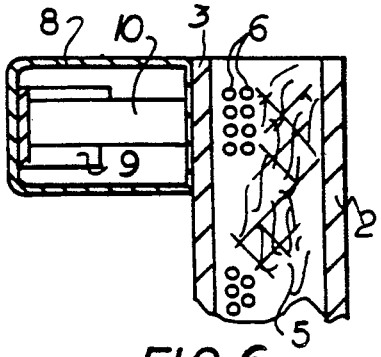
FIG. 6 is a section through the embodiment of FIG. 5 taken along the line 6—6 of FIG. 5.

The spacing between the walls 21–24 and 31–34 of the two shells can be fixed by a separator means represented in FIG. 2*a*, for example, as synthetic resin spacers. The spacer can be a grid, such as a rectangular grid, a honeycomb or the like. In addition or as an alternative to the synthetic resin spacers 4, a filling 5 constituted by a synthetic resin particle/mineral particle mixture may be used.

With this construction, the inner shell 2 which has high mechanical strength in and of itself, is free from the drawback of the rubber lining system previously required. However, even if there should be some acid penetration of the inner shell, the second or outer shell prevents leakage into the workplace.

The complete filling of the space between the shells increases the load-bearing capacity of the inner shell several times. Depending upon the thickness of this intermediate layer, various load-bearing capacities can be ensured.

The entire assembly is, of course, self-supporting and free-standing so that support structures need not be provided for the receptacle. It is customary to mount an electrolysis cell on four insulating blocks and thus to provide support at only four points. In addition, the upper edge of the receptacle must be capable of withstanding high loads. With large receptacles there is a tendency to bending of the receptacle following filling with the electrolyte. Generally a large number of such cells are positioned side-by-side and such bending can interfere with other cells and the distortions can be additive so that exact crane positioning for lowering and raising of electrolysis plates by a traveling crane can be interfered with.

To prevent such bulging or buckling of the electrolysis cell with the electrolysis cell of the invention, we provide within the synthetic resin/mineral mixture prestressing elements 6 which apply an inward stress so that upon loading of the receptacle with the electrolyte, no net bending of the walls of the receptacle will occur. The prestressing can be determined based upon empirically measured forces and loads with filled receptacles.

Naturally, the prestressing should apply such inward forces to the walls that, after filling, the walls are in their desired position and no bulging of the receptacle is noted. Since bulging at the bottom of the receptacle can be precluded by supporting it from below, the tendency to bulging increases from the bottom to the top and reaches a maximum value at the upper edge of the receptacle. According to the invention, therefore, the prestress increases from the bottom to the upper edge.

For this purpose, the prestressing elements 6 can be assembled in groups 7 with the number of prestressing elements per group increasing upwardly.

The prestressing elements are preferably composed of glass fiber strands since even with a rupture of the inner shell and the passage of acid into contact with the prestressing elements, glass fiber strands will not be attacked.

Other materials which are not readily subject to acid attack or which can be used when the electrolysis acid may attack glass fiber strands, are carbon fibers, polyester fibers and the like.

We can even employ acid-resistant steel wire which preferably is covered with a synthetic resin sheath.

Large receptacles can be provided with a frame 8 of exterior steel construction, for example, steel profiles, which is disposed around the outer rim of the receptacle and which serves to prevent any outward bulging in the regions of the rim. Because spatial requirements do not allow massive frame structures, the frame should have the smallest possible profile and can be provided internally with at least one prestressing element 9 which can bear against spacer elements 10 and provides an internal prestress to the outer shell at the upper edge thereof. As a result, an initial bulge inwardly may be provided at the upper edge which disappears upon filling of the cell.

Figure 7:
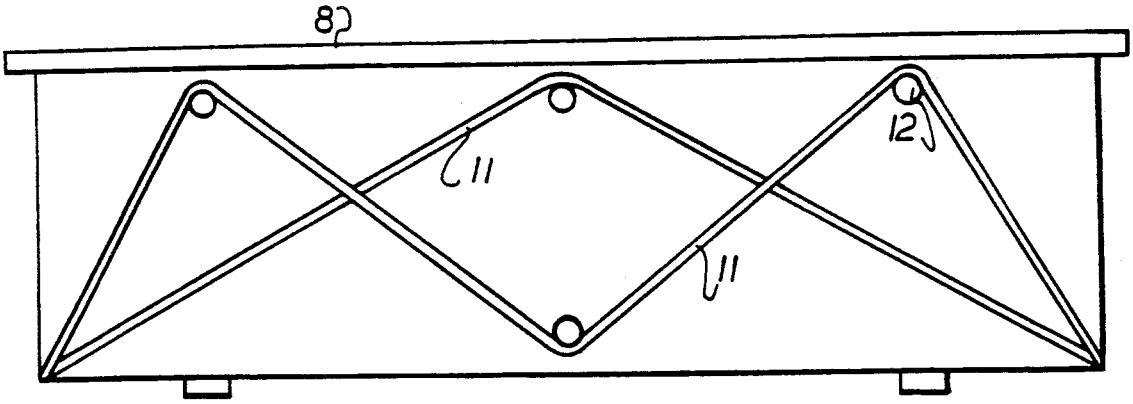
FIG. 7 is an elevational view showing the zigzag arrangement of the prestressing elements.

FIG. 7 shows an arrangement of the prestressing elements 11 in a longitudinal wall of the receptacle 1. The prestressing element 11 run in a zigzag pattern having their origins at the corners of the receptacle and having inflection bends where they pass over spacers 12 perpendicular to the walls 21 - 23 and 31 - 33 of the receptacle.

We claim:

1. A self-supporting electrolytic cell comprising:

nested inner and outer shells each having a bottom wall and side walls and each made of a glass-fiber-reinforced synthetic resin;

means including spacers between the shells for holding same apart and defining a space therebetween; and a plurality of horizontally extending and tensioned prestressing wires in the space being inward on the inner shell, the wires being arranged to apply an inwardly directed prestressing force on the inner wall that increases upward from the bottom walls.

2. The self-supporting cell defined in claim 1 further comprising a synthetic resin/mineral mixture disposed between said shells.

3. The self-supporting cell defined in claim 1 wherein said prestressing wires are glass-fiber strands.

4. The self-supporting cell defined in claim 1 wherein said prestressing wires are composed of carbon fibers.

5. The self-supporting cell defined in claim 1 wherein said prestressing wires are composed of polyester fibers.

6. The self-supporting cell defined in claim 1 wherein said prestressing wires are corrosion-resistant steel wires sheathed in synthetic resin.

7. The self-supporting cell defined in claim 1 wherein said prestressed wires are arranged in groups and the number of said wires in each group increases upwardly from said bottom walls.

8. The self-supporting cell defined in claim 1, further comprising a frame surround said cell outwardly of said side walls along upper edges of said side walls.

9. The self-supporting cell defined in claim 8 wherein said frame is composed of structural steel shapes having at least one prestressing element.

10. The self-supporting cell defined in claim 1 wherein in a vertical plane of one of said shells, mutually offset zigzag-pattern prestressing wires are disposed which extend from corners of said one of said shells and have inflection change bends in regions of spacers forming said separator means.

* * * * *